United States Patent [19]

Wallin

[11] 3,941,649

[45] Mar. 2, 1976

[54] PROCESS FOR OBTAINING A PREDETERMINED KAPPA NUMBER IN SULFATE PULPING

[75] Inventor: Erik Gunnar Wallin, Domsjoverken, Sweden

[73] Assignee: Mo och domsjo Aktiebolag, Ornskoldsvik, Sweden

[22] Filed: Nov. 23, 1973

[21] Appl. No.: 418,634

Related U.S. Application Data

[63] Continuation-in-part of Ser. No. 378,768, July 12, 1973, abandoned.

[30] Foreign Application Priority Data

July 14, 1972 Sweden ..... 9341/72

[52] U.S. Cl. ..... 162/19; 162/49; 162/62; 162/238; 324/65 R

[51] Int. Cl.[2].... D21C 3/22; D21C 3/24; D21C 7/12

[58] Field of Search ..... 162/49, 62, 17, 238, 242, 162/38, 19; 324/34 R, 65 R

[56] References Cited

UNITED STATES PATENTS

| | | | |
|---|---|---|---|
| 2,950,177 | 8/1960 | Brown et al | 324/65 R |
| 3,652,384 | 3/1972 | Sloman | 162/49 X |
| 3,679,543 | 7/1972 | Rivers | 162/49 |
| 3,886,034 | 5/1975 | Noreus | 162/62 X |
| 3,888,726 | 6/1975 | Hultman | 162/49 |

OTHER PUBLICATIONS

MacLeod, "Autocook System Brings Full Automation to Batch Digesters," Paper Trade Journal (Aug. 16, 1971) pp. 36–39.

Grant, "Computer Applications: Woodlands Through Bleach Plant–II," Paper Trade Journal (June 21, 1971) pp. 36–41.

Hatton, "Application of Empirical Equations to Kraft Progress Control," TAPPI V. 56, No. 8 (Aug. 1973), pp. 108–111.

Vroom, "The H' Factor: A Means of Expressing Cooking Times and Temperatures as a Single Variable," Pulp & Paper Mag. of Canada (Convention Issue 1957), pp. 228–231.

*Primary Examiner*—S. Leon Bashore
*Assistant Examiner*—Arthur L. Corbin

[57] ABSTRACT

A fully controllable process is provided for the manufacture of sulfate pulp having a predetermined degree of delignification and therefore a predetermined Kappa number. A sample of the pulping liquor is taken at a stage at which the preliminary alkali-consuming physical and chemical reactions and processes have substantially been completed, the sample is analysed to give the content of alkali in the liquor, and the alkali content adjusted to at least 20 g calculated as NaOH per kilogram of wood initially added, by addition of alkali. From this alkali content the pulping intensity expressed as "H" factor for obtaining the desired Kappa number is determined, and the pulping time and pulping temperature during delignification are controlled according to this H factor. It is also possible to adjust the alkali content in a controllable manner by injecting white liquor, black liquor or water into the digester. The process is applicable to continuous digesters as well as batch digesters.

10 Claims, 3 Drawing Figures

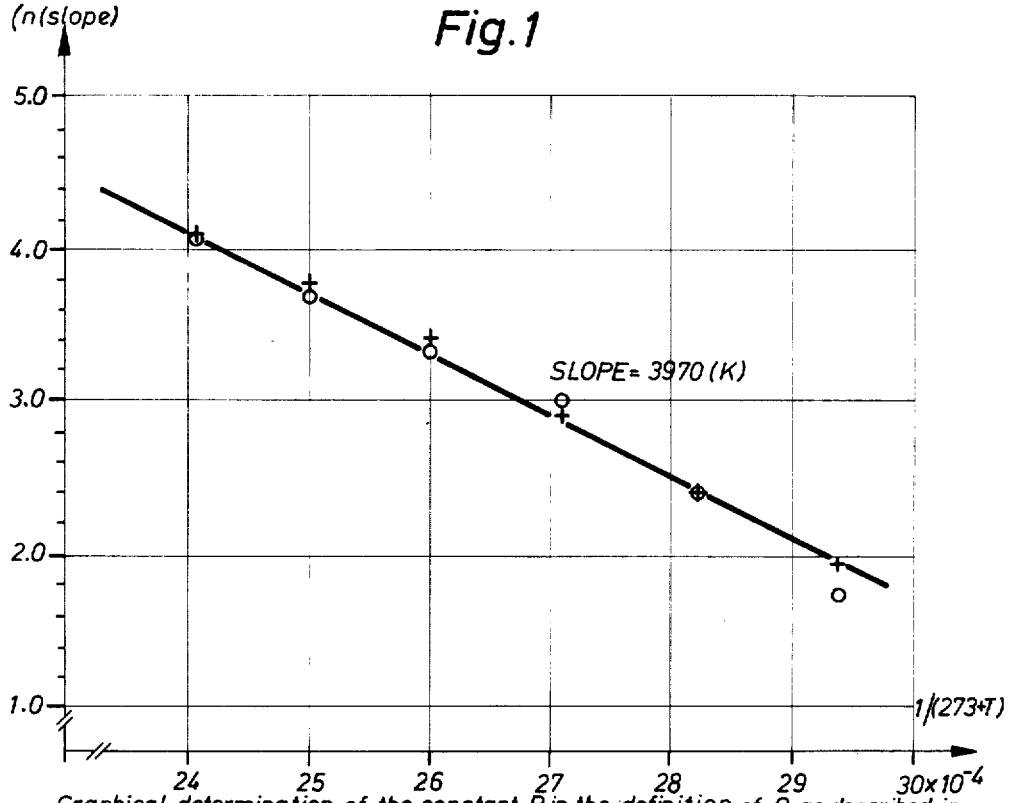
Graphical determination of the constant B in the definition of Q as described in example 1
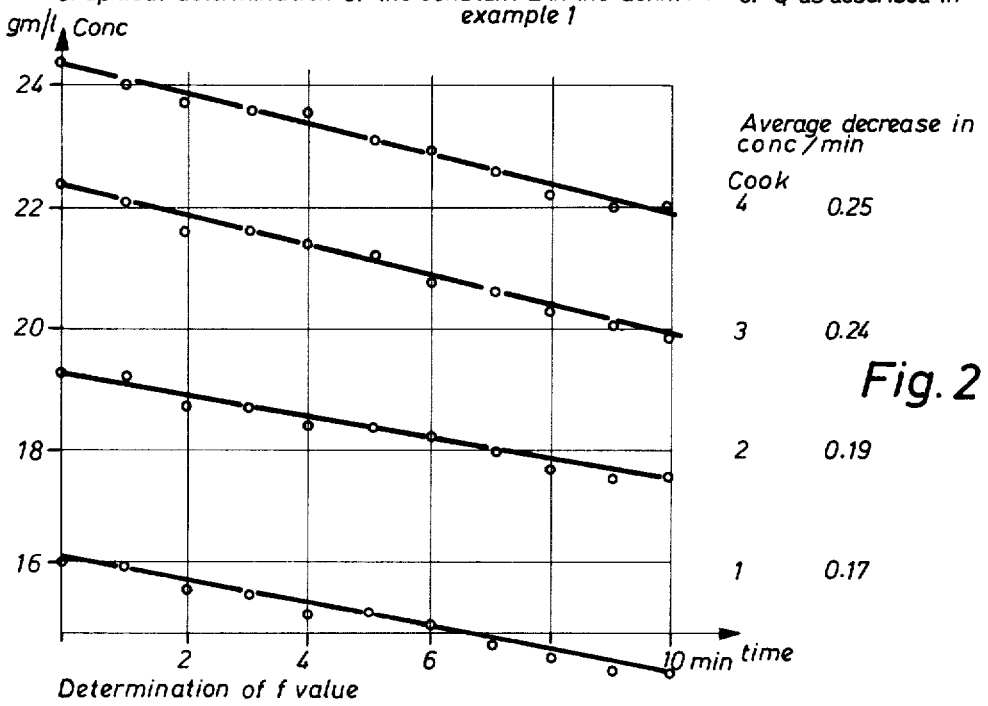
Determination of f value

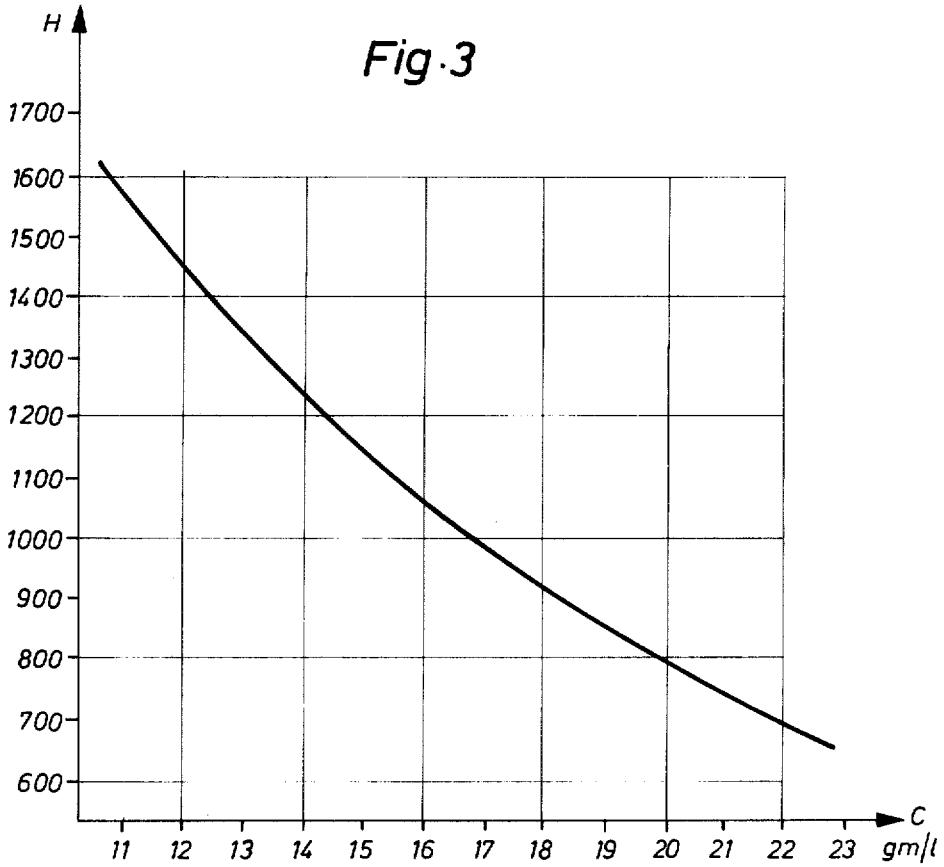
H-factor needed to obtain a pulp with Kappa number = 33 US concentration of effektive alkali in liquor sample taken when Q = 111

PROCESS FOR OBTAINING A PREDETERMINED KAPPA NUMBER IN SULFATE PULPING

This application is a continuation-in-part of Ser. No. 378,768, filed July 12, 1973 and now abandoned.

In the alkaline sulfate pulping of wood, the wood is treated at 150° to 190°C with an aqueous solution of alkali, usually sodium hydroxide, and sodium sulphide. This is the most common alkaline digesting method in practice. The purpose of this treatment is to remove the lignin, i.e. delignification, in order to free the fibres without damage.

The degree to which the starting material is delignified (normally measured in Kappa number) during digestion depends on the end use of the pulp. An optimum degree of delignification is found for each conceivable area of use and any deviation from this optimum will increase manufacturing costs, e.g. processability and quality of the pulp are impaired, pulp yield is reduced, consumption of bleaching chemicals is increased, or emission of undesirable substances to the environment is increased. All these effects result in increased manufacturing costs. Thus, it is highly desirable to control the cooking process, so that a pulp with a predetermined Kappa number can be obtained. The extent to which the starting material is delignified during the cooking process, however, depends on several factors, of which quality of the starting material e.g. the wood, amount of chemicals charged to the system, ratio of wood to liquor and time-temperature sequence of the cook are the most important.

It is known that the quality of wood (chemical composition of the wood, its bark content, the occurrence of rot damage and the size of chips) reflects itself mainly in a varied alkali consumption during the initial stages of the cook, as a result of certain preliminary reactions between the wood and the cooking liquor prior to delignification. Immediately after the alkaline cooking liquor is brought into contact with the wood, there is a substantial consumption of alkali in these preliminary physical and chemical reactions and processes. The most important reaction is the neutralization of the acid groups of the wood, including the free phenol groups of the lignin and also partly the anhydroglucose units of the cellulose. Very soon thereafter, catalyzation of the xylan and glucomannans takes place, as well as hydrolysis of other easily-hydrolyzed ester bonds. Degradation of carbohydrates follows by a "peeling" reaction, at a velocity that is considerably enhanced after about 70°C is reached. This reaction continues, unit by unit. After a certain number of units have been peeled off, the reaction ceases. Then, alkaline hydrolysis of the chains at temperatures about 140°C results in a resumption of the peeling reaction, by chain fission, with the formation of aldehyde end groups. Dissolution of the hemicellulose and other carbohydrate molecules takes place and diffusion of alkali into the interior of the wood chips also occur, as an essential preliminary to the delignification reaction. These reactions and processes result in a significant and unpredictable decrease in the alkali content of the cooking liquor.

These reactions and processes substantially terminate before the actual delignification process begins. Consequently, in accordance with this invention, the amount of alkali remaining in the system for delignification is determined by taking and analysing a sample of the cooking liquor at this stage, subsequent to this initial period and before substantial delignification begins, and controlling the remaining stages of the cooking process on the basis of the results obtained in this analysis, so as to obtain the desired degree of delignification.

The sampling time, however, must be at the stage at which the preliminary reactions and processes have terminated, in order to provide an alkali content of the cooking liquor on which control of the continued cooking sequences involving delignification can be based.

It has been proposed to utilize a carefully established time-temperature sequence during the initial stage of the cook until the samples are taken. It is impossible, however, to maintain such a sequence in practice in a pulp manufacturing plant, because of fluctuations in the condition controls for the system and in production rate, which are reflected in variations in the rate of increase of temperature and in the residence time in the impregnation zone. The latter is characteristic for continuous cooking processes. Hitherto, there has been no reliable method of determining the alkali content accurately under such circumstances.

The present invention eliminates the above difficulties, and makes it possible to determine an appropriate sampling time no matter what the actual time-temperature sequence used. In accordance with the invention, the alkali content as NaOH is determined after the wood to be pulped has been subjected to a preliminary pulping for at least thirty minutes at a temperature within the range from about 100°C to at least 140°C but below a temperature and for a time less than that at which substantial delignification takes place. Under these conditions the preliminary reactions and processes are substantially complete and since delignification has not begun, the delignification reaction can still be controlled. The delignification conditions are then selected according to the determined alkali content and the desired Kappa number in the pulp using a pulping time and temperature relationship determined by the H factor for this alkali content which yields pulp of this Kappa number. If necessary, after the alkali content of the sample has been determined the alkali content of the pulping liquor is adjusted to at least 20 g per kilogram of wood as initially added. Such adjustment is dependent upon the degree of delignification desired in the digestion process used. In the preparation of high yield pulp (Kappa number about 100) at least about 20 g of alkali per kg of wood usually is needed, whereas when producing bleachable grades of chemical pulp (Kappa number, about 30) usually at least 35 grams per kilogram of wood is preferable.

The alkali content of the pulping liquor at this stage thus determines the H factor required for pulp of a given Kappa number. This means that for reproducible pulping conditions, what is needed in the initial pulping stages is a pulping liquor of a given alkali content. The initial pulping conditions can vary as desired, if the pulping liquor has substantially the same alkali content at the end of the preliminary pulping.

In accordance with the invention, a process is provided for determining with considerable accuracy the conditions required for any desired degree of delignification, and thus makes it possible to reproducibly prepare sulfate pulps of uniform quality. In the process of the invention, the wood is pulped to a desired Kappa value under pulping conditions established on the basis of H factor determined from a graph of H factor against Kappa value over a range of alkalinities (in terms of g/l.

NaOH) corresponding to the alkalinities required for the pulping of the type of wood selected. A family of such curves, one for each of a series of alkalinities within such range, serves as the reference graph. The alkalinity of one or more samples taken at an early stage from a pulping liquor used to pulp the same type of wood is determined by titration with an acid, to an end point determined as the limiting relatively constant value of the conductivity of the sample that is reached as conductivity decreases during the acid titration. Thus, the alkalinity of the sample obtained by this measurement establishes the curve of the reference graph applicable to this sample of wood, and from this curve that is thus selected, the H factor applicable to obtain a sulfate cellulose pulp having a predetermined Kappa value is read off. The H factor in turn establishes pulping time and/or pulping temperature for the selected degree of delignification.

In the process of the invention, to obtain a sample of alkaline liquor for the determination, the sulfate pulping is begun in the conventional manner, by charging and thoroughly mixing wood chips and alkaline pulping liquor in the digester. A sulfate pulping liquor, as is well known, is an aqueous solution of alkali, usually NaOH, and $Na_2S$. The pulping is then begun, and allowed to continue for an initial pulping period during which at least 20% of the alkali added initially up to about 85% of the alkali added initially, preferably from 40% to 75%, has been consumed, after which a sample of the pulping liquor is taken, and titrated with an acid to the end point determined as the limiting conductivity of the sample. Thus, either a gradually or rapidly increasing temperature during the initial pulping can be used as desired but approximately the same rate of increase would be used afterwards as before. The determination is usually valid only for initial heating rates and temperatures approximating those used in obtaining the sample.

In preparing the pulping sample for titration, the rate of temperature increase during the initial pulping stages can be within the range from about 0.1°C/minute to about 25°C/minute, preferably from about 0.5° to about 10°C/minute.

The time-temperature dependence of the preliminary initial reactions and processes in producing a pulping liquor of equivalent alkalinity can be summarized in one factor, referred to hereinafter as the Q-factor, similar to Vroom's H-factor. The Q-factor is defined by the equation $$Q = \int_0^t e^{A-B/T} dt$$

where:

$e$ is the base in the natural logarithm system (the value of $e$ is 2.71828)

$T$ is the temperature in degrees absolute ($K$)

$t$ is the time in minutes from the start of the cook $A$ and $B$ are constants determined by trial and error experimentation.

The value of the constant $B$ is determined by laboratory measurements of the alkali degradation during the initial stages of digestion using the same starting material and the same charging conditions as those used during a full scale operation. The following procedure is suggested:

The digester is charged according to the normal charging routine and the temperature is increased from room temperature to 150°C at a rate of 1.0°C/minute. A small amount of liquor is withdrawn from the digester every ten minutes, starting at $T$=60°C, and continuing until the temperature has reached 150°C. The concentration of effective alkali in each sample is determined, preferably using a conductometric titration technique which is based on the characteristic change of conductivity in black liquor when a strong acid is added or any other method giving the necessary accuracy (±0.2 gm/l). The alkali content is expressed as effective alkali (g as NaOH). The successive values of effective alkali are denoted $C_i$. The quantity $1/C_i - 1/C_o$ is graphed against time, and the slope of the curve calculated at several points. The logarithm of the slopes plotted against 1/temp (temperature in K) will give a straight line with the slope −B in the given equation for Q. One example of this calculation is given below. As a result of such measurements, it has been established that $B$ should lie within the range from 2000 to 6000K, preferably in the range from 3500 to 4500K. Corresponding values for the majority of chemical reactions are approximately 15000K, which indicates that the obtained reaction mainly represents a physical mechanism, e.g. the diffusion of alkali into wood fragments.

The constant A in the above equation can be given any value, but it is convenient to put $A = B/373$, e.g. the exponent in the given expression becomes = 0 at 373K (100°C).

In order to facilitate the computation of Q, the following Table comprising the time derivative of Q at three different values of B as function of temperature is given.

TABLE I

TIME DERIVATIVES FOR THE "Q" FACTOR AT DIFFERENT TEMPERATURES FOR THREE DIFFERENT VALUES OF B dQ/dt units/minute

| Temperature °C | B = 3500K | B = 4000K | B = 4500K |
|---|---|---|---|
| 80 | 0.59 | 0.53 | 0.50 |
| 85 | 0.67 | 0.63 | 0.60 |
| 90 | 0.77 | 0.74 | 0.71 |
| 95 | 0.88 | 0.86 | 0.85 |
| 100 | 1.00 | 1.00 | 1.00 |
| 105 | 1.13 | 1.15 | 1.17 |
| 110 | 1.27 | 1.32 | 1.36 |
| 115 | 1.43 | 1.51 | 1.59 |
| 120 | 1.60 | 1.72 | 1.84 |
| 125 | 1.79 | 1.94 | 2.11 |
| 130 | 1.99 | 2.20 | 2.43 |
| 135 | 2.21 | 2.48 | 2.78 |
| 140 | 2.46 | 2.80 | 3.18 |
| 145 | 2.72 | 3.14 | 3.63 |
| 150 | 3.00 | 3.51 | 4.10 |
| 155 | 3.31 | 3.93 | 4.66 |
| 160 | 3.65 | 4.40 | 5.29 |
| 165 | 4.00 | 4.88 | 5.95 |
| 170 | 4.41 | 5.41 | 6.70 |

Once the constant B has been determined in the aforementioned manner for the specific starting material to be delignified, the Q-factor can be used for determination of the preliminary pulping conditions needed to give a desired alkali content in the pulping liquor at the end of the preliminary pulping. This makes it possible to vary the preliminary pulping conditions and still obtain equivalent alkali content in the pulping liquor at this stage. It is thus possible to see when to sample the pulping liquor to confirm that this stage has been reached.

While this determination can be made mathematically, it can also be made by trial and error experimentation, sampling the liquor and determining alkali content at various stages of the sequence in the preliminary pulping. The results are the same, since the mathematical computation is merely a device for achieving mathematically what would otherwise require trial and error experimentation.

In batch digestion, the time and temperature in the digester are continuously registered, and the Q-factor can be calculated by means of tables, graphs or preferably computers or dataprocessing devices in accordance with the given equation from the beginning of the pulping, e.g. the moment when the charging of the digester is completed. When the calculated value for Q has reached a predetermined value $Q_o$ a sample of the pulping liquor is taken and analysed in a suitable manner, further described below.

The temperature rise in the digester during the preliminary pulping stage can follow any conceivable pattern, temperature drops caused by pressure drops excepted. The choice of $Q_o$ is governed by some practical restrictions, among which the most important are that the sampling moment must not be selected at too early a stage in the pulping sequence before the preliminary reactions and processes are complete, since the incomplete initial reactions will impose an unpredictable deficiency in the alkali content. Neither is it permissible to select the sampling moment at a stage beyond completion of the preliminary reactions and processes, after substantial delignification has begun.

It has been found that $Q_o$ should lie within the range from 50 to 200, preferably from 100 to 120, if B= 4000K and A= 4000/373 in the equation for Q.

Any procedure for analysing the samples of pulping liquor to determine alkali content can be used. A preferred procedure is conductometric titration, but any other known procedure giving the same accuracy can be used. Any convenient conductivity-measuring device or meter can be used. One useful conductivity meter is provided with a reference electrode, for example the Kemotron four-electrode type, which registers electrical conductivity at different acid charges.

Conductometric titration is performed in the following manner. A small known volume ($V_1$) of liquor is diluted with water in a ratio of 1 to 30; the conductivity of this solution is measured continuously while an acid of known strength ($C_a$) is added causing the conductivity to decrease, until after a certain amount of acid has been added, a constant value is reached. The amount of acid ($V_2$) added to reach this point is a measure of the concentration of effective alkali in the sample, the concentration being $C = C_a \cdot V_2/V_1$.

The acid employed in the titration is an organic or inorganic acid, preferably an inorganic acid, and preferably an acid which is nonoxidizing under the titration conditions. The acid is used in dilute aqueous solution. The normality of the solution is not critical, and can be within the range from about 0.1 to about 6N. Preferred acids are sulfuric acid and hydrochloric acid. Sulfuric acid has the advantage of a high sulfur content, which corresponds to the pulping liquor. Other inorganic acids such as orthophosphoric acid, hydrobromic acid, hydroiodic acid, metaphosphoric acid and pyrophosphoric acid also can be used, as well as organic acids such as acetic, formic, trichloroacetic and propionic acids. Strong oxidizing acids such as persulfuric acid and nitric acid may be used under some conditions, but usually should be avoided.

The amount of acid added during the titration to the end point corresponds to the amount of alkali present, and the latter can therefore be determined by calculation from the amount of acid. The alkali content is calculated as NaOH in g/l.

The determination of the pulping conditions needed at this alkali content to produce pulp of a given Kappa value is made with the aid of any conceivable digestion model, such as Tables or graphs derived from the data and results obtained from previously effected pulpings, with the starting material in question, or by mathematical expressions utilizing the actual value of $Q_o$.

The alkali concentration makes it possible to select the correct curve to determine H factor for a given (desired) Kappa value on the reference graph. The reference graph is composed of a family of curves, one for each alkali concentration (NaOH in g/l) at which a pulping can be carried out over the entire range of useful alkali concentrations. One reference graph is set up for each type of wood to be digested, for instance, spruce, fir, pine, birch, eucalyptus, beech, oak, maple, aspen, cedar, hemlock, cherry, chestnut, locust, elm, and the curves are based on the Kappa values obtained for pulps processed at given H factors in the digester to be used. Thus, each plant would establish its own reference graph empirically, based on actual pulping experience for the type of wood to be pulped.

After the correct curve for the determined alkali concentration has been ascertained, the H factor for the Kappa value of pulp desired can be read off, and from the H factor the pulping temperature and pulping time can be ascertained.

The H factor corresponds to a unit of pulping, and represents the number of hours of pulping at 100°C. At a higher temperature, more units of pulping can be completed within a given time, and at a lower temperature, less. Thus, H factor is a measure of how much pulping is needed — at 100°C., or at temperatures above and below 100°C.

In fact, any pulping temperature can be used in the process of the invention, within the range from about 110° to about 180°C., and the pulping times also can be widely varied, from about 1 minute to about ten hours, preferably from about 160° to about 180°C. for from about 15 minutes to about 3 hours. The H factor determines how long the pulping must be at a selected temperature, and vice versa, for a given Kappa value, at the alkali concentration determined in the titration.

One such model is described in the Examples. In this model cooking intensity is expressed in terms of a modified H factor, first described by Vroom, *Pulp and Paper Magazine of Canada* 1957, pages 228 to 231.

The H factor defined by Vroom is given by the expression $$H = \int_0^t k.dt \qquad t = \text{time in hours}$$

In this equation k is the reaction rate for the delignification, arbitrarily set at unity at 100°C.

The temperature dependence of k is given by the Arrhenius equation:

$$\log_e k = C - D/_T$$

where $k$ is the reaction rate $C$ and $D$ are constants $T$ is the absolute temperature (K)

The constant $D$ in this equation is equivalent to the so-called activation energy for the reaction in question and it seems likely that its value is different for different types of starting material. Vroom has chosen the value $D = 16113$ (K) based on results reported by Larocque and Maass, *Canadian Journal of Research*, B19:1–16(1941). Consequently the constant C assumes the value 16113/373 in Vroom's equation for the H factor.

The modified H factor used in the Examples is essentially the same as the H factor defined in Vroom, the only difference being the value of D, which, based on an investigation made by L. Johnsson *Acta Polytechnica Scandinavia* May 22, 1971, page 40, has been assigned the value 14250, and consequently $C = 14250/373$. According to this, a Table can be made which gives the reaction rates of delignification in sulfate pulping related to the rate at 100°C. The table is given below:

TABLE II

RELATIVE RATE VALUES FOR VROOM'S "H" FACTOR AND FOR THE MODIFIED "H" FACTOR USING THE ACTIVATION ENERGY 14250 IN SULFATE PULPING

| | Relative rates/hour[2] | | | Relative rates/hour[2] | |
|---|---|---|---|---|---|
| Temperature °C | Vroom's H[1] | Modified H[1] | Temperature °C | Vroom's H[1] | Modified H[1] |
| 100 | 1 | 1 | 145 | 105 | 61 |
| 105 | 2 | 2 | 150 | 165 | 91 |
| 110 | 3 | 3 | 155 | 258 | 135 |
| 115 | 5 | 4 | 160 | 398 | 198 |
| 120 | 9 | 7 | 165 | 609 | 289 |
| 125 | 15 | 11 | 170 | 923 | 417 |
| 130 | 25 | 17 | 175 | 1385 | 597 |
| 135 | 41 | 26 | 180 | 2060 | 848 |
| 140 | 66 | 40 | | | |

[1]Figures rounded to nearest integer.

[2]The rate values for intermediate temperatures can be obtained by interpolation or by calculation using the given formula $k = \exp(D(1/373 - 1/(273 + T)))$.

Employing these relative rate values, a curve of rate against time in hours can be plotted for any cooking cycle, and the area under such a curve is designated as the H factor.

The H factor represents the number of units of digestion per hour at 100°C. The total number of digestion units needed, the H factor value from the reference graph curve, can be obtained using the above table as a multiple of the lower number of units per hour at lower temperatures, or as a fraction of the higher number of units per hour at higher temperatures.

As a simplified example, let it be assumed that the Vroom's H factor indicated by the reference graph curve is 398. Then, the desired Kappa value will be obtained after the equivalent of a 1 hour pulping at 160°C, or a 2 hour pulping at 152°C, or a three hour pulping at 147°C; or a one-half hour pulping at 168°C. This is an oversimplification because as a practical matter, however, the pulping is not carried out solely at the temperature of the Table, but over a gradual heating to the pulping temperature, and the H factor represents the units of digestion over the entire pulping cycle. Thus, the computation is slightly more complicated, and in fact the H factor for any pulping cycle represents the area under a relative reaction rate versus time curve. Thus, the H factor determines the shape of any of an infinite number of curves that can be used for a given pulping.

As a further example, let it be assumed that the H factor is 1587. To obtain such an H factor value, one can use a pulping cycle of 1½ hours in the rising temperature stage from 80°C to 170°C, and 1½ hours at 170°C in the final pulping stage. This is shown by the following computation:

TABLE III

| Time from start (hours) | Temp. °C | Relative rate of reaction | Average rate | × | Time Interval (hours) | = | "H" factor[1] |
|---|---|---|---|---|---|---|---|
| 0.00 | 80 | 0 | | | | | |
| | | | 0 | × | ¼ | = | 0 |
| 0.25 | 95 | 1 | | | | | |
| | | | 2 | × | ¼ | = | 1 |
| 0.50 | 110 | 3 | | | | | |
| | | | 9 | × | ¼ | = | 2 |
| 0.75 | 125 | 15 | | | | | |
| | | | 41 | × | ¼ | = | 10 |
| 1.00 | 140 | 66 | | | | | |
| | | | 162 | × | ¼ | = | 41 |
| 1.25 | 155 | 258 | | | | | |
| | | | 591 | × | ¼ | = | 148 |
| 1.50 | 170 | 923 | | | | | |
| | | | 923 | × | ¼ | = | 1385 |
| 3.00 | 170 | 923 | | | | | |
| | | | | | Total | | 1587 |

[1]Calculated to the nearest whole number. This table gives Vroom's H-factor. The modified H-factor according to Table II is calculated in a similar manner giving the result H = 729.

In the above calculation, in the rising temperature stage of the cycle, the relative rate values have been averaged over one-quarter hour periods. While of course this is an approximation, it may be satisfactory for some purposes. More accurate approximations are recommended and can be obtained by taking smaller time intervals, or other methods such as Simpson's rule or the trapezoidal rule may be employed.

Thus, any conditions of pulping temperature and time which give the H factor that has been determined can be used.

The total H factor for a pulping sequence is thus given by the integral given in the definition of the H factor, or more conveniently by summarizing H fragments during short time intervals, chosen according to temperature increase rates and the accuracy wanted. It is suggested that the time interval should not exceed 5 minutes while temperature is constant, and 1 minute during heating. The computation of the H factor can be performed with the aid of Tables, as shown, graphs, or preferably an electronic, analog or digital computer.

Thus, the digestion conditions model based on trial and error experimentation, using data and results from previously performed pulpings comprising alkali concentration values (C) of samples taken at a constant $Q_o$, as previously described. The total H factor (H) obtained for the pulping and the resulting degree of delignification preferably is expressed as the Kappa number ($\kappa$) of the resulting pulp. The H factor and Kappa values are plotted and the H values read off the curves. A mathematical model can also be prepared giving the model needed for determination of the H factor necessary to obtain a pulp with a predetermined Kappa number at each alkali content of the pulping liquor.

The mathematical model is most conveniently obtained by multiple regression techniques, using one of the basic formulas:

$$H = \sum_{i=o}^{n} \sum_{j=o}^{m} a_{ij} \cdot C_o^i \cdot \kappa^j$$

$$\text{or } 1/H = \sum_{i=o}^{n} \sum_{j=o}^{m} b_{ij} \cdot C_o^i \cdot \kappa^j$$

where $a_{ij}$ and $b_{ij}$ are constants, $C_o$ is the concentration of effective alkali in the sample of cooking liquor and $\kappa$ is the Kappa number. $i$, $j$, $m$, $n$ are integers.

It is also possible to establish a pulping model by solving a system of equations derived from basic physical relationships:

$$dL/dt = -k \cdot L.C$$

$$C = \Sigma c_i L^i$$

$$c_i = c_i (C_o, Q_o, \rho)$$

$$L = \Sigma d_i.\kappa^i$$

$$H = e \cdot \int_o^t k \cdot dt$$

$$\log_e(k) = A - B/T$$

$$T = \text{function of } t$$

where $L$ = Lignin "concentration" in the digester
$C$ = Alkali concentration
$C_o$ = Alkali concentration of sample
$k$ = Rate constant for the delignification
$\rho$ = Liquor to wood ratio
$\kappa$ = Kappa number
$H$ = H factor
$Q_o$ = "Q" factor when sampling
$T$ = Temperature in K
$t$ = time $c_i$, $d_i$, $e$, $A$ and $B$ are constants whose values are determined either by laboratory investigations or by regression technique. It is emphasized, however, that the present invention is not dependent on the manner in which the obtained value of the alkali concentration is used to control the process. The model can appear in any conceivable shape including such models aimed for an adjustment of the alkali concentration in the digester by injecting liquids of any kind. Such a model can appear in the following form:

$$V = V_o \cdot \frac{(C_1 - C_2)}{(C_3 - C_2)}$$

where $V$ = Volume of liquor to be injected, the same volume is simultaneously withdrawn.
$V_o$ = Volume of liquor in the digester.
$C_1$ = Concentration of alkali in the liquor needed to obtain predetermined Kappa number using a fixed time/temperature schedule for the pulping.
$C_2$ = Concentration of alkali in the liquor sample.
$C_3$ = Concentration of alkali in the injected liquor.

The aforementioned method of adjusting the concentration of the pulping liquor is under certain circumstances the most favorable when continuous digesters are concerned. In this case, however, it is not possible to choose the sampling moment according to a predetermined value of $Q_o$. It is necessary to take the liquor samples at some fixed point in the system, preferably in the recirculation system for pulping liquor between the impregnation and pulping (high temperature) zones or between the impregnation vessel and the digester if the impregnation is performed in a separate system outside the digester. The concentration of alkali in such a sample is dependent on the residence time of wood and liquor in the impregnation zone and the temperature profile within the same. The recorded concentration of alkali can, however, be used for control purposes if its value is normalized to a specific operational case using the relationship:

$$C_o = C \cdot e^{f \cdot (Q - Q_o)}$$

where, $C_o$ is the concentration of alkali applicable to standardized digesting conditions
$C$ is the concentration of alkali in the sample
$Q$ is the obtained Q factor value for that sample
$Q_o$ is the Q factor value at standardized conditions
$e$ is the base in the natural logarithm system and
$f$ is a constant.

This relationship between the concentration of two different liquor samples is derived from the general finding that $$dC/dt = -f \cdot C \cdot dQ/dt$$

e.g. the time derivative of concentration of alkali during the initial stages of pulping is proportional to actual concentration value and the "impregnation rate" given by $dQ/dt$, the proportionality constant being $f$. The value of $f$ is to be found in the range $1.5 \times 10^{-3} - 4.0 \times 10^{-3}$; the exact value is determined in accordance to the chosen values for the constants in the Q factor and the specific starting material to be digested.

The process when applied to continuous digesters will then be in brief: The process is best understood if the digester is considered as number of batch digesters placed on top of each other and the digester content displaced in discrete steps from one section of the digester to the next. The residence time in each section is determined from measurements of the flow rate and the feed rate. The temperature is measured continuously utilizing a number of measuring points arranged so that a continuous temperature profile can be determined. From this temperature profile the temperature of each section is determined as a mean value during the actual residence time. Thus it is possible to follow each section of wood through the digester, and to calculate the appropriate values for Q and H needed to normalize obtained values of alkali concentration according to the given equation and to use these values to perform the necessary control actions, which depending on the actual situation can be of any conceivable kind including a feed back control of the amount of white and black liquor charged to the top of the digester. The main advantage of the process of the invention is, however, its possibility to maintain a reliable feed forward control of the digestion process by a close control of the digester temperature in the digesting zone.

The process of the invention as used in batch digestion will now be illustrated by Examples, although it is emphasized that it is not restricted to such processes. The reason for selecting Examples from batch digestion is that the advantages are best illustrated in this way. One experienced in the field of continuous digestion should be able to apply these Examples to such continuous processes.

The Examples confirm that the process of the invention enables pulp manufacturing processes to be controlled without the need of any serious restrictions on the time-temperature schedule. This indicates that further advantages besides the exactly controlled degree of delignification can be obtained by means of an attached control system for the steam consumption in the digesting house. The latter could be based on production rates and economic criteria without jeopardizing the quality of produced pulp.

It will also become evident that the process of the invention will make it possible to utilize the know method of increasing the yield in batch pulp manufacturing processes effected according to the sulphate method, by withdrawing pulping liquor from the digester subsequent to the impregnation and returning the liquor when the delignification process is completed, since the impregnating process can be monitored with the aid of the Q factor. Thus, in this way it is also possible to utilize the other advantages afforded by such pulping processes, namely:

1. Reduced energy consumption when effecting delignification.
2. Well defined termination point of delignification — better control results.
3. Time gained since the necessary drop in temperature prior to blowing the digester is rapid.

EXAMPLE 1

A small laboratory digester was charged and run in the following manner:

| | |
|---|---|
| Wood | Pine chips, mean thickness 3.0 mm. |
| Alkali | 22% on wood as active alkali |
| Sulfidity | 35% |
| Liquor to wood ratio | 3.7 l/kg |
| Time-temperature sequence | 1.0°C/min. from 20°C to 150°C. |
| Liquor samples | One sample each 15 minutes, starting when the temperature is = 60°C. |
| Sample volume | 100 ml. |
| Analysis | Concentration of effective alkali according to the conductometric titration method (NaOH equiv./l)=C. |

This investigation was intended to establish the value of constant $B$ in the expression for the $Q$ factor, and gave the following results (two separate runs of the program).

TABLE IV

DETERMINATION OF B IN A LABORATORY DIGESTER

| | | Batch I | | | Batch II | | |
|---|---|---|---|---|---|---|---|
| Time min. | Temp. °C | C gm/l | $1/C_t - 1/C_a$ | Slope $\times 10^5$ | C gm/l | $1/C_t - 1/C_a$ | Slope $\times 10^5$ |
| 0 | 60 | 35.3 | 0 | 6 | 33.1 | 0 | 7 |
| 15 | 75 | 34.2 | 9 | 11 | 32.1 | 10 | 11 |
| 30 | 90 | 32.4 | 25 | 20 | 30.4 | 27 | 18 |
| 45 | 105 | 29.6 | 55 | 28 | 28.1 | 54 | 30 |
| 60 | 120 | 26.3 | 97 | 40 | 24.9 | 99 | 43 |
| 75 | 135 | 22.7 | 157 | 59 | 21.5 | 163 | 60 |
| 90 | 150 | 18.9 | 246 | | 18.0 | 253 | |

A plot of $\log_e$ (slope) vs $1/(273 + T)$ will give a straight line, the slope of which is ~4000 (K), as shown in FIG. 1, where the factor $10^5$ is omitted.

EXAMPLE 2

This investigation was intended to establish the value of $f$ in the expression for determining alkali concentration at the end of the preliminary reactions and processes.

Four different pulpings charged according to normal routine and heated from approximately 90°C at a rate of increase in temperature of approximately 1°C/min were studied with respect to the alkali content in the temperature range of 145°–155°C. One liquor sample was withdrawn per minute, starting at 145°C. The samples were analysed according to the conductometric titration method. The results obtained are given in Table V.

TABLE V

DETERMINATION OF f IN A FACTORY DIGESTER

| | | Cook No. | | | |
|---|---|---|---|---|---|
| | | 1 | 2 | 3 | 4 |
| Temp. °C | Time min. | Concentration in gm/l NaOH | | | |
| 145 | 0 | 16.1 | 19.2 | 22.4 | 24.4 |
| | 1 | 16.0 | 19.1 | 22.1 | 24.0 |
| | 2 | 15.7 | 18.7 | 21.6 | 23.7 |
| | 3 | 15.6 | 18.7 | 21.6 | 23.6 |
| | 4 | 15.3 | 18.5 | 21.4 | 23.6 |
| 150 | 5 | 15.3 | 18.4 | 21.2 | 23.2 |
| | 6 | 15.1 | 18.2 | 20.8 | 23.0 |
| | 7 | 14.8 | 17.9 | 20.7 | 22.6 |
| | 8 | 14.6 | 17.6 | 20.4 | 22.2 |
| | 9 | 14.4 | 17.4 | 20.1 | 22.0 |
| 155 | 10 | 14.4 | 17.4 | 19.9 | 22.0 |

A plot of these figures is given in FIG. 2. Using the value $dQ/dt = 3.55$ (B= 4000 K and T = 150°C) the following $f$ values are obtained in the expression $dC/dt$ $= -f \cdot C \cdot dQ/dt$. The $C$ value is taken when $T = 150°C$

| Cook number | 1 | 2 | 3 | 4 |
|---|---|---|---|---|
| $f \cdot 10^3$ | 3.17 | 2.94 | 3.23 | 3.07 |
| giving the mean value $f = 3.1 \cdot 10^{-3}$ ($\pm 0.2\ 10^{-3}$). | | | | |

EXAMPLE 3

During tests on a plant scale on pine wood, without equalizing possible variations in the wood starting material and without making special effort to control the charged proportions, it was established that a good relationship prevails between the Kappa number obtained and the total H factor of the pulping, according to the modified H factor described above, and the effective alkali content of the pulping liquor. The heating sequence was carefully controlled during the test, so that heating was commenced immediately after the charging of the digester had been completed, and the temperature increase was at a rate of 1°C per minute to 170°C starting at approximately 90°C.

A sample was taken at 150°C. The result for a specific Kappa number level can be seen in FIG. 3, in which the necessary H factor for obtaining this Kappa number is plotted as a function of effective alkali concentration in the digester, measured under the described circumstances.

The relationship shown graphically in FIG. 3 can be expressed by the equation:

$$1/H = (-35.1 + 2.58 \cdot C^2 - 9.36 \cdot C^2\kappa \times 10^{-3} + 0.36 \cdot \kappa^2) \times 10^{-6}$$

The Q factor, as defined in accordance with the invention, is 111 for the given schedule, using $B$ = 4000°K. This was used on a laboratory scale to determine when to sample to determine alkali content and compared against the obtained model in the following manner.

Two test series were run, in which the following heating sequences were applied.

Series A 90°C to 170°C with temperature increase of 0.5°C/min.

Series B 90°C to 120°C with temperature increase of 1.0°C/min., 60 min. at 120°C, thereafter 1.0°C/min. to 170°C.

The sampling time was calculated using the Q factor equation taking as the value for $Q_o$ the Q value obtained in accordance with the standard sequence. The following sampling times and temperatures were thus calculated:

| | Sampling time minutes from start | Sampling temperature °C | "Q" factor when sampling |
|---|---|---|---|
| Standard sequence | 60 | 150 | 111 |
| Series A | 81 | 131 | 111 |
| Series B | 84 | 120 | 111 |

The samples were taken at the prescribed times, and the alkali contents determined. The values obtained for the concentrations of effective alkali in the pulping liquor ($C$, g NaOH/l) were then used to determine the necessary H factor by reading off the graph shown in FIG. 3. The different pulpings were terminated when the necessary H factor was obtained.

All the pulpings were found to produce a pulp with the desired Kappa number with a good accuracy, without any significant deviation for any of the test series which is shown in Table VI. The results show that the time/temperature control technique based on the alkali content determined at the conclusion of the preliminary reactions and processes gives reproducible results, no matter how the time-temperature sequence applied during the heating period is selected, provided that the sample is taken at a constant value for $Q$.

It is emphasized that the model used in this Example is simplified, and is not to be used outside the limits $\kappa$ = 28–37, $C$ = 12–24 gm/l as NaOH and $H$ = 600–1600, because it is based on values within these ranges.

TABLE VI

TESTING OF "Q" FACTOR CONTROLLED SAMPLING MOMENTS IN A LABORATORY DIGESTER DESIRED KAPPA NUMBER = 33

| Standard sequence | | | | Series A | | | | Series B | | | |
|---|---|---|---|---|---|---|---|---|---|---|---|
| C gm/l | "H" factor | Minutes at 170°C | κ obtained | C gm/l | "H" factor | Minutes at 170°C | κ obtained | C gm/l | "H" factor | Minutes at 170°C | κ obtained |
| 12.1 | 1450 | 195 | 34.4 | 13.2 | 1330 | 166 | 34.7 | 12.7 | 1380 | 173 | 34.1 |
| 13.9 | 1245 | 166 | 32.3 | 14.3 | 1210 | 148 | 33.1 | 13.5 | 1285 | 159 | 34.2 |
| 14.6 | 1185 | 157 | 33.8 | 15.6 | 1100 | 133 | 34.2 | 15.3 | 1120 | 135 | 32.8 |
| 15.8 | 1075 | 141 | 33.2 | 17.2 | 970 | 114 | 31.7 | 15.9 | 1070 | 128 | 33.5 |
| 15.9 | 1070 | 141 | 32.2 | 19.9 | 800 | 90 | 32.4 | 17.2 | 970 | 114 | 32.1 |
| 18.0 | 915 | 119 | 31.4 | 20.3 | 775 | 86 | 32.1 | 20.1 | 785 | 87 | 32.2 |
| 21.2 | 725 | 91 | 32.4 | 22.4 | 665 | 70 | 33.9 | 21.8 | 695 | 75 | 32.9 |
| 22.1 | 680 | 85 | 34.4 | | | | | | | | |
| Mean Value | | | 33.0 | | | | 33.2 | | | | 33.1 |
| Std. dev. ± | | | 1.1 | | | | 1.1 | | | | 0.8 |

The results show that the model used was slightly inaccurate, but adequate.

EXAMPLE 4

In a series of plant tests in which the digesters were charged according to the normal procedure, the liquor samples were taken at 150°C, regardless of the heating sequence used. Thus, the sampling in each case was not subsequent to completion of the preliminary reactions and processes. The alkali contents were then calculated back to the completion stage according to the expression:

$$C_o = C \cdot e^{f \cdot (Q - Q_o)}$$

as previously described, using $B$ = 4000°K, $f = 3.1 \times 10^{-3}$ and $Q_o$ = 111, corresponding to the digestion model given in the preceding Examples. The results obtained were used to determine the H factor, on which control of the pulping was based. The results appear in Table VII.

TABLE VII

| Pulping Run No. | "Q" factor when sampling | C gm/l as meas. | $C_o$ gm/l corr. | "H" factor ($\kappa = 33$) | Time Minutes at 175°C | Obtained $\kappa$ |
|---|---|---|---|---|---|---|
| 1 | 86 | 18.4 | 17.1 | 980 | 84 | 32.3 |
| 2 | 94 | 16.2 | 15.4 | 1120 | 98 | 33.1 |
| 3 | 109 | 16.9 | 16.8 | 995 | 86 | 32.1 |
| 4 | 112 | 14.3 | 14.3 | 1210 | 107 | 32.8 |
| 5 | 117 | 16.3 | 16.6 | 1005 | 87 | 32.8 |
| 6 | 123 | 15.6 | 16.2 | 1030 | 89 | 31.9 |
| 7 | 131 | 12.8 | 13.6 | 1275 | 114 | 32.7 |
| 8 | 146 | 13.2 | 14.7 | 1180 | 104 | 33.2 |
| 9 | 151 | 12.1 | 13.7 | 1270 | 113 | 34.6 |
| 10 | 159 | 14.0 | 16.3 | 1020 | 88 | 34.3 |
| | | | | Mean value $\kappa$ | | 33.0 |
| | | | | Std. dev. | | 0.9 |

The results show that the correction is properly made.

Having regard to the foregoing disclosure, the following is claimed as the inventive and patentable embodiments thereof:

1. A fully controllable process for the manufacture of sulfate cellulose pulp having a predetermined degree of delignification and therefore a predetermined Kappa number, which comprises combining and holding particulate wood and sulfate pulping liquor under preliminary alkali-consuming reaction conditions until such reactions have substantially been completed and before substantial delignification has begun; taking a sample of the pulping liquor at this stage of the process; analyzing the sample and obtaining the content of alkali in the liquor; adjusting the alkali content to at least 20 g calculated as NaOH per kilogram of wood initially added, by addition of alkali; from this alkali content determining the pulping intensity expressed as H factor for obtaining the desired kappa number in the sulfate cellulose pulp; and controlling the pulping time and pulping temperature during delignification, according to this "H" factor, in order to obtain said desired kappa number.

2. A process according to claim 1, in which the alkali content is adjusted by injecting white liquor.

3. A process according to claim 1, in which the alkali content is adjusted by injecting black liquor.

4. A process according to claim 1, in which the alkali content is adjusted by injecting water.

5. A process according to claim 1, in which the preliminary alkali consuming reaction conditions are at least 30 minutes at a temperature within the range from about 100°C to at least 140°C but below a temperature and for a time less than that at which substantial delignification takes place, such that the preliminary reactions and processes are substantially complete, and delignification has not begun.

6. A process according to claim 1, which comprises adjusting the alkali content to at least 35 grams per kilogram of wood.

7. A process according to claim 1, which comprises determining the conditions required for any desired degree of delignification, and reproducibly preparing sulfate pulps of uniform quality, by pulping wood of the same type to a desired Kappa value under pulping conditions established on the basis of H factor determined from a graph of H factor against Kappa value over a range of alkalinities (in terms of g/l. NaOH) corresponding to the alkalinities required for the pulping of the type of wood selected, thereby obtaining a family of such curves for that wood, one for each of a series of alkalinities within such range, serving as a reference graph.

8. A process according to claim 1, which comprises determining the alkalinity of at least one sample, from a pulping liquor used to pulp the same type of wood, by titration with an acid, to an end point determined as the limiting relatively constant value of the conductivity of the sample that is reached as conductivity decreases during the acid titration.

9. A process according to claim 1, which comprises charging and thoroughly mixing wood chips and alkaline sulfate pulping liquor in a digester, the sulfate pulping liquor comprising an aqueous solution of alkali metal hydroxide and alkali metal sulfide; holding the wood chips and sulfate pulping liquor under preliminary alkali consuming reaction conditions at an increasing temperature during which at least 20% of the alkali added initially up to about 85% of the alkali added initially has been consumed; taking a sample of the pulping liquor; and titrating the sample with an acid to the end point determined as the limiting conductivity of the sample.

10. A process according to claim 9, in which the rate of temperature increase during the preliminary alkali consuming reaction is within the range from about 0.1°C/minute to about 25°C/minute.

* * * * *

PO-1050
(5/69)

UNITED STATES PATENT OFFICE
CERTIFICATE OF CORRECTION

Patent No. 3,941,649 Dated March 2, 1976

Inventor(s) Erik Gunnar Wallin

It is certified that error appears in the above-identified patent and that said Letters Patent are hereby corrected as shown below:

[73] Page 1 : "Mo och domsjo" should be --Mo och Domsjo--

Column 7, line 15 : "in" should be --by--

Column 10, line 33 : $C_o = C \cdot e^{f \cdot (Q-Q)}$ should be $$C_o = C \cdot e^{f \cdot (Q-Q_o)}$$

Column 13, line 53 : after "defined" please insert --above--

Column 14, line 61 : $C_o = C \cdot e^{f \cdot (Q-Q)}$ should be $$C_o = C \cdot e^{f \cdot (Q-Q_o)}$$

Signed and Sealed this

Thirteenth Day of July 1976

[SEAL]

*Attest:*

RUTH C. MASON
*Attesting Officer*

C. MARSHALL DANN
*Commissioner of Patents and Trademarks*